United States Patent [19]

Phillips

[11] 3,983,345

[45] Sept. 28, 1976

[54] METHOD OF DETECTING A LEAK IN ANY ONE OF THE VACUUM INTERRUPTERS OF A HIGH VOLTAGE CIRCUIT BREAKER

[75] Inventor: Virgel E. Phillips, Springfield, Pa.

[73] Assignee: General Electric Company, Phila., Pa.

[22] Filed: Jan. 30, 1975

[21] Appl. No.: 545,636

[52] U.S. Cl. ..... 200/144 B; 317/11 R; 317/62; 307/136

[51] Int. Cl.[2] ..... H01H 33/66

[58] Field of Search ..... 200/144 B; 317/11, 62; 307/136

[56] References Cited

UNITED STATES PATENTS

| | | | |
|---|---|---|---|
| 1,972,362 | 9/1934 | Sorensen | 200/144 B |
| 3,403,297 | 9/1968 | Crouch | 317/62 |
| 3,472,981 | 10/1969 | McCarty et al. | 200/144 B |
| 3,626,125 | 12/1971 | Tonegawa | 200/144 B |
| 3,641,359 | 2/1972 | McCarty | 307/136 |
| 3,814,885 | 6/1974 | Sofianek | 200/144 B |
| 3,839,612 | 10/1974 | Badey et al. | 200/144 B |

*Primary Examiner*—Robert S. Macon
*Attorney, Agent, or Firm*—William Freedman; J. Wesley Haubner

[57] ABSTRACT

Discloses a method of detecting a leak in any one of the vacuum-type circuit interrupters of a high voltage vacuum circuit breaker comprising a plurality of normally series-connected interrupters located within a tank of the circuit breaker containing pressurized gas. Through small openings in the wall of the tank, a first set of conductive rods are inserted to make electrical connection with predetermined terminals of the interrupters. Through other small openings in the tank wall, a second set of conductive rods, insulated from the tank wall, are inserted to make electrical connection with predetermined other terminals of the inrterrupters. These predetermined terminals are such that the interrupters are connected electrically in parallel between the first and second sets of rods. Between said first and second sets of rods a test voltage is applied to the interrupters in parallel that is of sufficient value to produce a high probability of dielectric breakdown within any interrupter stressed by said voltage that has lost its vacuum, thus providing an indication of such a loss of vacuum.

7 Claims, 5 Drawing Figures

METHOD OF DETECTING A LEAK IN ANY ONE OF THE VACUUM INTERRUPTERS OF A HIGH VOLTAGE CIRCUIT BREAKER

BACKGROUND

This invention relates to a method of detecting a leak in any one of the vacuum-type circuit interrupters of a high-voltage vacuum circuit breaker comprising a plurality of series-connected interrupters located within a housing of the circuit breaker containing pressurized insulating gas.

The following references are of interest with respect to this invention: U.S. Pat. Nos. 3,403,297-Crouch; 3,472,981-McCarty et al; 3,626,125-Tonegawa; 3,641,359-McCarty; 3,814,885-Sofianek.

One way of checking a vacuum interrupter for a leak is to apply a high potential across its terminals. If the inturrupter contains a leak which has allowed the pressure therein to rise to a level of 0.01 torr or higher, then the high potential will ordinarily produce a sparkover within the interrupter, which can be readily detected. But in prior designs of the type of vacuum circuit breaker that I am concerned with, i.e., high-voltage vacuum circuit breakers that comprise series-connected interrupters located within a closed tank filled with pressurized gas, the terminals of the interrupter may not be accessible unless all the insulating gas in the tank is removed, the tank is opened, and the circuit breaker pole is significantly dismantled. This procedure, of course, can be time-consuming and therefore expensive.

SUMMARY

Accordingly, an object of my invention is to provide a method of detecting a leak in any one of the normally series-connected interrupters of such a circuit breaker which does not require removing all the insulating gas from the tank or dismantling any significant part of the circuit breaker.

In carrying out my invention in one form, I provide the tank wall with a plurality of small openings that are normally sealed but can be opened to allow rod structures to be inserted therethrough into the tank interior. When it is desired to check the interrupters for loss of vacuum, I insert through these openings rod structures having conductive portions that make connection with the terminals of the interrupters in such a way as to connect the interrupters electrically in parallel the rod structures. The conductive portions of at least one of the rod structures are insulated from the tank. I then apply between the rod structures a test voltage which is high enough to produce a high probability of sparkover in any stressed interrupter that has lost its vacuum. The test voltage is monitored to determine whether such a sparkover occurs, thus providing an indication of whether any of the interrupters has lost its vacuum.

DETAILED DESCRIPTION OF PREFERRED EMBODIMENTS

Figure 1:
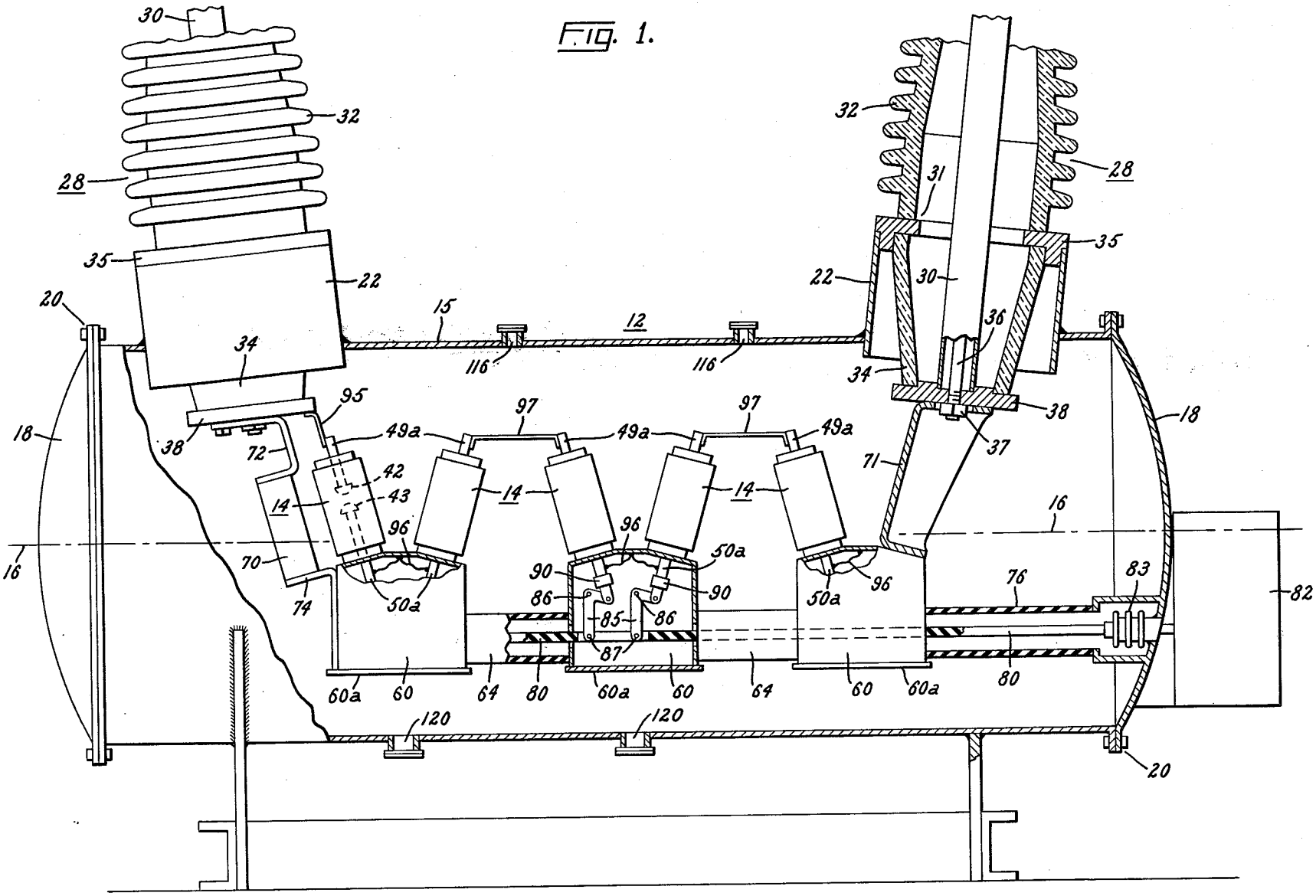
FIG. 1 is a side elevational view, partly in section and partly schematic, showing a vacuum circuit breaker containing vacuum-type circuit interrupters. The method of my invention is used for detecting a loss of vacuum in any one of these interrupters.

Referring now to FIG. 1, the circuit breaker shown therein is of generally the same design as the circuit breaker shown and claimed inthe aforesaid Badey et al patent. As such, it comprises a metal tank 12 at ground potential and a plurality of vacuum interrupters 14 located within the tank. The illustrated tank 12 comprises an elongated cylindrical portion 15 having a central longitudinal axis 16 that extends horizontally. At opposite ends of cylindrical portion 15 are two dished heads 18 suitably secured to the cylindrical portion, as by bolted flange connections 20.

Adjacent the opposite ends of cylindrical tank portion 15, there are two tubular bushing pockets 22 extending transversely of the axis 16 and communicating with the interior of the tank. Disposed within each of these pockets 22 is a high voltage terminal bushing 28 of a conventional construction also extending transversely of axis 16. Each of these terminal bushings comprises a rigid central conductor 30 and a housing 31 surrounding the conductor comprising two tubular shells 32 and 34 of porcelain and a tubular midsection 35 of metal disposed between the porcelain shells. The parts of the bushing housing 31 are held together in compression by suitable clamping means comprising a stud 36 having a nut 37 threaded on its lower end and bearing against an end cap 38.

Figure 2:
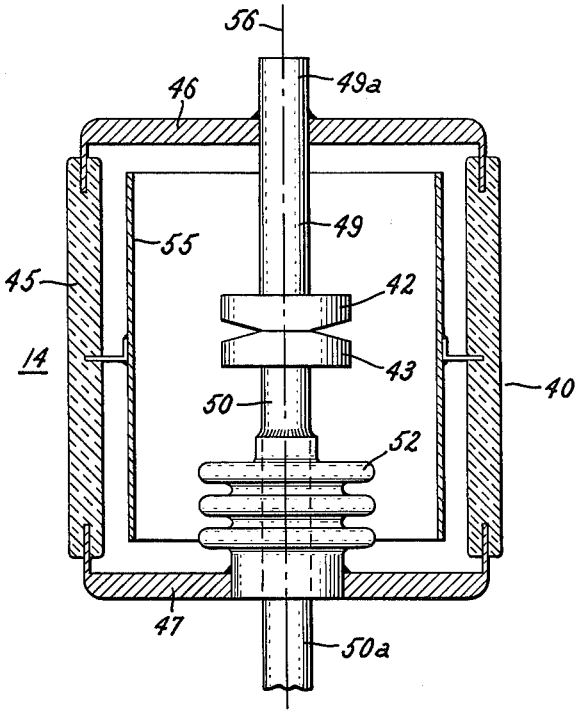
FIG. 2 is a sectional view of one of the vacuum interrupters utilized in the circuit breaker of FIG. 1.

Referring to FIG. 2, each of the vacuum interrupters 14 is of a conventional design. As such, it comprises a highly-evacuated envelope 40 and a pair of separable contacts 42 and 43 within the envelope. The envelope comprises a tubular casing 45 of insulating material having a central longitudinal axis 56 and metal end caps 46 and 47 suitably sealed to the casing at its opposite ends. Contact 42 is a stationary contact fixed to the lower end of a stationary contact rod 49 that extends in sealed relationship through the upper end cap 46. Contact 43 is a movable contact fixed to the upper end of a movable contact rod 50 that extends freely through the lower end cap 47. A flexible metallic bellows 52 jointed at its respective opposite ends to the movable contact rod 50 and end cap 47 provides a seal about the movable contact rod and allows for reciprocation of the contact rod without impairing the vacuum inside the envelope.

When the contacts 42 and 43 are in their engaged position, the vacuum interrupter is closed. Opening is effected by driving the movable contact rod 50 downwardly to separate the contacts. This establishes an arc which is extinguished in a known manner at an early current zero. For condensing the arcing products, a tubular metal shield 55 surrounding the contacts in spaced relationship is provided within the envelope.

Closing of the interrupter is effected by driving the movable contact rod 50 upwardly from its open position to reengage the contacts 42 and 43.

For supporting the vacuum interrupters, there are provided three identical hollow metal supports 60. On each of two of these supports 60 a pair of the interrupters 14 is mounted, as shown in FIG. 1. On the remaining support 60 only a single interrupter 14 is mounted. In the illustrated embodiment, each of the supports 60 for an interrupter is located at the lower end of the interrupter. The movable-contact end of each interrupter envelope is shown fixed to its associated support 60, and the movable contact rod 50 projects into the interior of this hollow support 60.

The metal supports 60 are arranged in horizontally-spaced relationship and are fixed to each other by means of insulating tubes 64 disposed between the metal supports. These insulating tubes are suitably attached at their opposite ends to the supports 60. The metal supports 60, the insulating tubes 64 secured therebetween, and the interrupters 14 secured to supports 60 together form a unitary interrupting assembly. This unitary interrupting assembly is supported from the lower ends of the terminal bushings 28.

For supporting the interrupter assembly from the lower ends of the terminal bushings, an insulator 70 is provided at the left hand end of the interrupter assembly, and a conductive metal support 71 is provided at the right hand end of the interrupter assembly. Insulator 70 has end fixtures 72 and 74 fixed to its opposite ends. The upper end fixture 72 is suitably secured to the lower end of the terminal bushing, and the lower end fixture 74 is suitably secured to an end one of the metal housings 60. The metal support 71 at the right-hand end of the interrupter assembly has flanges at its opposite ends respectively fixed to housing 60 and the end plate 38 of the right-hand terminal bushing.

In the embodiment shown in FIG. 1, additional insulating support for the interrupter assembly is provided in the form of a tube 76 of insulating material extending horizontally between the interrupter assembly and the tank 12 and suitably attached at its respective opposite ends to the interrupter assembly and the tank.

For operating the interrupters 14 substantially in unison, there is provided an operating rod 80 that in FIG. 1 extends in a horizontal direction through the housings 60 and the insulating tubes 64. A portion of the operating rod 80 also extends between the housing 60 at the extreme right hand end of the interrupter assembly and a conventional closing mechanism 82 for the interrupters located externally of the tank 12. A suitable seal, preferably in the form of a bellows 83, is provided about the operating rod where it extends through the tank wall.

For coupling the operating rod 80 to the movable contact rods 50 of the interrupters, a plurality of bellcranks 85, one for each interrupter, are provided. Referring to FIG. 1, in the cut-away, centrally-located housing 60, two of these bellcranks are shown respectively mounted on stationary pivots 86. One arm of each bellcrank is pivotally connected at 87 to the operating rod 80, and the other arm is coupled through a suitable wipe device 90 to the movable contact rod 50 of its associated interrupter. The same type coupling is present within each hollow support 60.

The illustrated operating rod 80 comprises a plurality of sections of insulating material and a plurality of sections of metal mechanically connected together in series. The section extending between the end support 60 and the tank wall is of insulating material; the section within each of the supports 60 that interconnects the cranks 85 disposed therein is of metal; and the section extending between each adjacent pair of supports 60 through an insulating tube 64 is of insulating material.

When the operating rod 80 is driven to the right from its position of FIG. 1, each of the bellcranks 85 is pivoted in a counterclockwise direction about its stationary pivot 86, thus driving the associated movable contact rod 50 upwardly through a closing stroke. This causes the movable contact 43 of each interrupter to engage its associated stationary contact 42, thereby closing the interrupter. Opening of the circuit breaker is effected by driving the operating rod 80 to the left from its closed position by suitable opening means (not shown).

The interrupters are electrically connected in series-circuit relationship with each other and with the bushing conductors 30. For electrically connecting the interrupter assembly to the conductor of left-hand bushing 28, a flexible connection 95 is provided between the lower end of the bushing conductor and the upper end 49*a* of the stationary contact rod 49 of the immediately-adjacent interrupter at the end of the assembly. Conductive support 71 and a flexible conductor 96 electrically connect the lower contact rod of the right-hand interrupter 14 to the lower end of right-hand bushing conductor 30. Between the movable contact rods of the interrupters of each associated pair of interrupters, a flexible conductor 96 is connected. Between the stationary contact rods of the adjacent interrupters in adjacent subassemblies of interrupters, a conductive strap 97 is suitably connected. Thus, the current path through the interrupter assembly, when closed, is of a zig-zag configuration; extending from connection 95 downwardly through the first interrupter 14 at the left-hand end of the assembly, then through conductor 96 and upwardly through the next interrupter 14, then through the conductor 97 and downwardly through the next interrupter, and so on.

Each of the interrupters 14 of the above-described interrupter assembly may be thought of as having two terminals respectively located at opposite ends of the interrupter. The upper end 49*a* of the stationary contact rod 49 constitutes one such terminal, and the lower end 50*a* of the movable contact rod 50 constitutes the other terminal.

When the circuit breaker is energized and closed, the interrupter assembly, including the housing 60, is at a high voltage with respect to the grounded metal tank 12. For electrically isolating the high voltage interrupter assembly from the grounded tank, a high dielectric strength insulating medium, in the form of a gaseous insulator under pressure, is provided within the tank 12. A suitable gaseous insulator is sulphur hexafluoride at a pressure of about 50 to 75 p.s.i. gauge. In one form of circuit breaker, the interior of the bushings 28 is also filled with this gaseous insulator. Suitable openings (not shown) in the bushing housing afford communication between the interior of the bushings and the interior of the tank. The interiors of the supports 60 and the insulating tubes 64 and 76 are in free communication with the rest of the tank space and thus also contain pressurized gaseous insulator.

Figure 3:
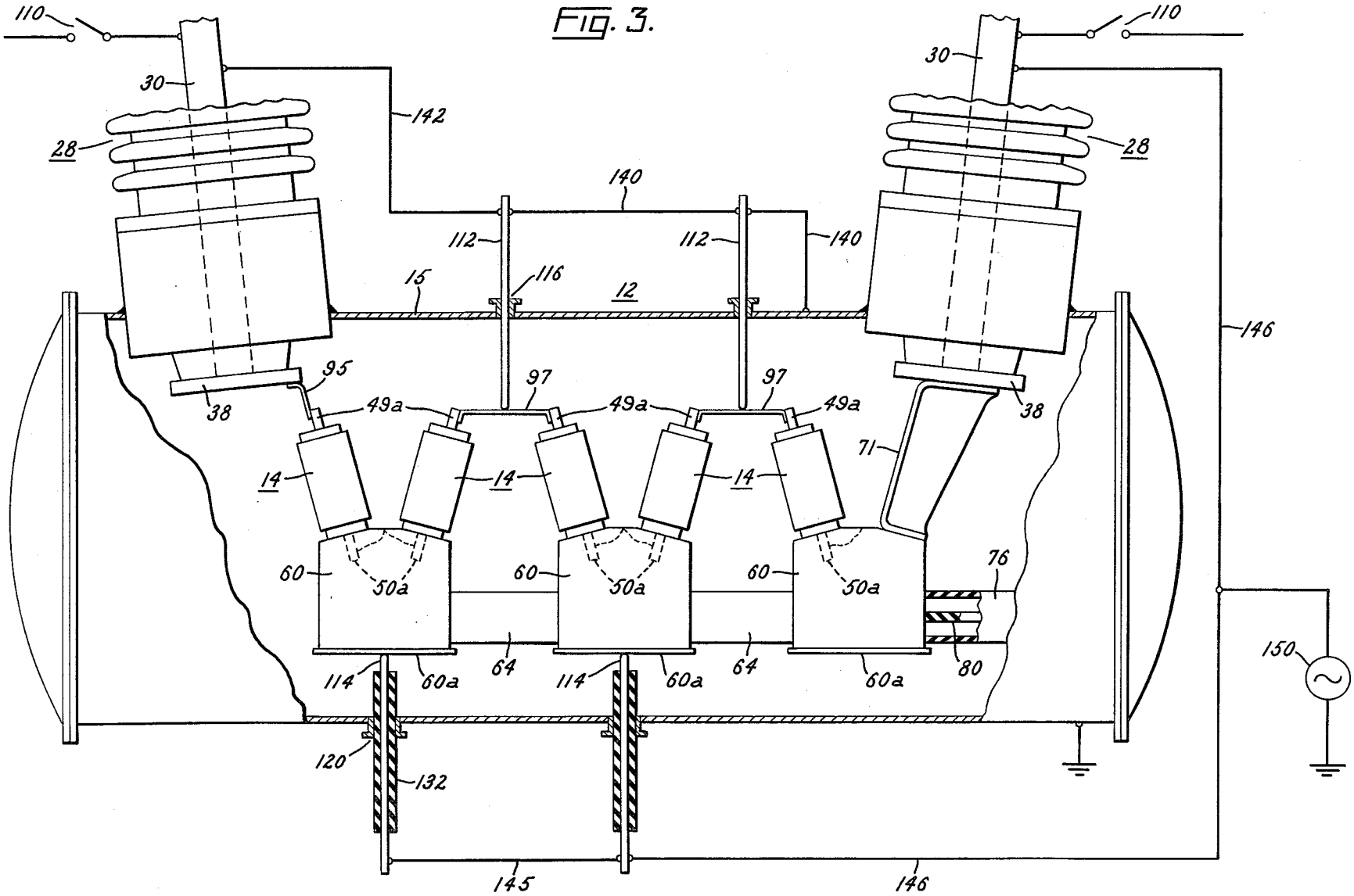
FIG. 3 is a schematic showing of the test equipment used for checking the vacuum interrupters of FIG. 1.

Assume now that it is desired to check the vacuum interrupters 14 for loss of vacuum. Referring to FIG. 3, the circuit breaker is first disconnected from its associated power line by opening suitable disconnect switches schematically shown at 110. Then the circuit breaker is operated into a partially open position is which a gap of a predetermined length is present between the contacts of each vacuum interrupter 14. Then pressurized insulating gas is removed from the tank 12 until the pressure therein falls to substantially atmospheric pressure.

After the above-described steps, rod structures (soon to be described) are inserted into the tank interior through openings in the wall of tank 12. One of these rod structures comprises a plurality of conductive rods 112, and the other comprises a plurality of conductive rods 114. Rods 112 are inserted through openings 116 in the top portion of the tank wall. As shown in FIG. 1, each of these openings 116 is normally closed by a cap, but each cap is removed just prior to insertion of rod 112 through the associated opening. The other rods 114 are inserted through openings 120 in the lower portion of the tank wall. Each of these openings 120 is normally closed by a cap, but each of these caps is removed just prior to insertion of rod 114 through the associated opening.

Figure 4:
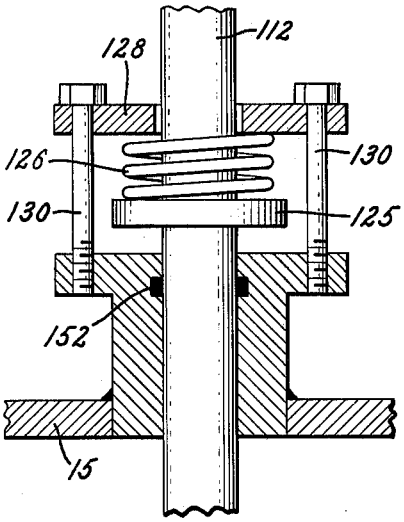
FIG. 4 is a detailed showing of one portion of the test equipment depicted in FIG. 3.

FIG. 4 is a more detailed showing of the region where one of the rods 112 passes through the tank wall. It will be noted that the rod has a shoulder 125 fixed thereto against which the lower end of a compression spring 126 bears. The upper end of spring 126 bears against a backup ring 128 that is attached to the tank by studs 130. Spring 126 serves to bias rod 112 downwardly so that the lower end of the rod, as shown in FIG. 3, makes good electrical connection with the upper terminals 49*a* of two of the interrupters through the conductive strap 97, which it engages. The other rod 112 is substantially identical to the rod 112 of FIG. 4, and it makes contact at its lower end with strap 97 thus providing a good connection between this rod and the upper terminals of the two interrupters 14 at the right hand end of the interrupter assembly.

Figure 5:
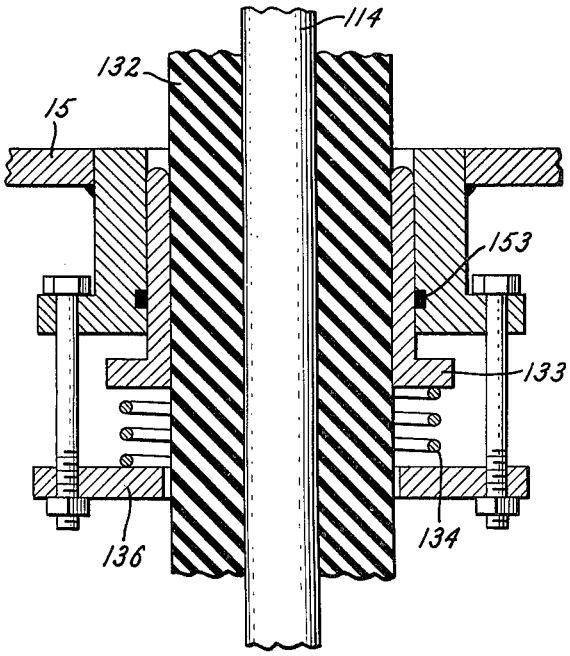
FIG. 5 is a detailed showing of another portion of the test equipment depicted in FIG. 3.

FIG. 5 is a more detailed showing of the region where one of the rods 114 passes through the tank wall. As illustrated, rod 114 has a tubular sleeve 132 of insulating material bonded thereto. Fixed to the outer periphery of sleeve 132 is a flanged metal sleeve 133 against the lower end of which the upper end of a compression spring 134 bears. The lower end of spring 134 bears against a backup ring 136 that is suitably fixed relative to the tank wall. Spring 134 biases rod 114 and sleeve 132 in an upward direction, forcing the upper end of the rod into engagement with the conductive floor 60*a* of the support housing 60, thereby making electrical connection with the lower terminals 50*a* of the vacuum interrupters mounted on housing 60.

The insulating sleeve 132 of FIG. 5 serves to electrically insulate the rod 114 from the tank 12 of the circuit breaker, as will be soon described.

The two rod subassemblies that make up the lower rod structure are substantially identical, and each of the conductive rods 114 thereof bears at its upper end against the floor of support housing 60, thereby making good electrical connection with the lower terminal 50*a* of the interrupter or interrupters mounted on the associated housing 60. This lower terminal, it is to be unerstood, is electrically connected to the associated housing 60.

Returning now to FIG. 3, after the upper rods 112 are inserted as shown, an electrical connection 140 is provided between their upper ends and also between the upper ends and the wall of tank 12, and other electrical connection 142 is provided between one of the rods 112 and conductor 30 of the left-hand terminal bushing 28.

After the lower rods 114 are inserted as shown, a first electrical connection 145 is provided between their lower ends, and another electrical connection 146 is provided between these lower ends and the conductor 30 of right-hand terminal bushing 28.

A source 150 of test voltage is then connected between the two rod structures 112 and 114. This source has its upper terminal connected to the lower rod structure 114 through conductors 145 and 146 and its lower terminal connected to the upper rod structure 112 through ground and the tank wall 15. It will be apparent from FIG. 3 that when the illustrated connections are in place, the individual interrupters 14 are connected electrically in parallel with each other between the rod structures 112 and 114 across the terminals of test voltage source 150.

In view of this parallel connection, the test voltage which is developed by source 150 is applied between the terminals 49*a* and 50*a* of each interrupter The voltage is preferably a 60 Hertz hipot voltage. The amplitude of the test voltage is made sufficiently high that there is a high probability of a dielectric breakdown across the relatively short inter-contact gap of any of the stressed interrupters that has lost its vacuum. The amplitude of the test voltage is made insufficiently high to produce a dielectric breakdown within any interrupter that still has an acceptable vacuum therein. The amplitude of the test voltage is also made insufficiently high to produce a dielectric breakdown externally of the interrupters. The high dielectric strength insulating gas remaining in the tank 12 when the test is being made insures that the test voltage will have little chance for producing a dielectric breakdown across any interrupter externally of the interrupter. The insulating sleeve 132 around each rod 114 assures that the test voltage will not produce a dielectric breakdown between the rod at high potential and the grounded wall 15 of the tank. The high dielectric strength insulating gas remaining in the tank assures that the creepage distance along the outer surface of sleeve 42, though relatively short inside the tank, is adequate to withstand test voltage applied between rod 114 and the grounded tank.

I have made it possible to use a relatively low test voltage which has little chance of producing a dielectric breakdown external to the interrupters because I do not fully open the interrupters for the above described test. By limiting the inter-contact gap to a relatively short length during the test, it is possible to sparkover the inter-contact gap with a relatively modest voltage if the interrupter has lost its vacuum. In one enbodiment of the invention, for the purpose of carrying out the above described test, I separate the contacts of each interrupter by about ¼ inch, as compared to a full separation of ¾ inch, and I utilize for a test voltage a 60 Hz voltage of 50KV r.m.s.

The test voltage source 150 includes suitable instrumentation (not shown) to determine and indicate whether a sparkover has occurred in response to application of the test voltage. If a sparkover does occur, this is an indication that one of the interrupters has lost its vacuum. The test may be repeated one or more times as a check on its accuracy.

It is to be noted that although high dielectric strength insulating gas is maintained in the tank 12 during the above-described test, most of the gas originally present is removed before the test voltage is applied. One reason for such partial gas removal is to drain any high pressure insulating gas from within a possibly-leaky interrupter. This is desirable because the presence of high presure insulating gas within an interrupter could prevent its breakdown by the test voltage, thus interfering with the desired leak detection.

For reducing the chances for contamination of the insulating gas during the above described test, I provide suitable seals around each of the rods. In this regard, note the O-ring type seals 152 in FIG. 4 and 153 in FIG. 5.

After the above-described test has been completed, the circuit breaker can be returned to service if the interrupters have passed the test. This is done by removing the rods 112 and 114, removing the connections 140, 142, 145, and 146, closing the openings 116 and 120, and restoring full gas pressure to the tank interior.

While I have shown and described a particular embodiment of my invention, it will be obvious to those skilled in the art that various changes and modifications may be made without departing from my invention in its broader aspects; and I, therefore, intend in the appended claims to cover all such changes and modifications as fall within the true spirit and scope of my invention.

What I claim as new and desire to secure by Letters Patent of the United States is:

1. A method of detecting loss of vacuum in one or more of the vacuum interrupters of a high-voltage vacuum circuit breaker that comprises: (i) a grounded metal tank containing a gaseous insulator, (ii) a plurality of vacuum interrupters located within said tank within said gaseous insulator and disposed in spaced relationship to the wall of the tank, each vacuum interrupter having spaced-apart terminals and separable contacts respectively connected to said terminals, (iii) means for normally electrically connecting said vacuum interrupters in series, and (iv) high voltage terminal bushings extending through said tank, each including a conductor for connecting the series combination of said vacuum interrupters to an external circuit, said method comprising:

a. operating said circuit breaker in a manner to provide a gap between the contacts of each vacuum interrupter, b. inserting through the wall of said tank at a first location first rod structure having electrically-connected conductive portions that make electrical connection with predetermined terminals of said interrupters, c. inserting through the wall of said tank at a second location spaced from said first location second rod structure having electrically-connected conductive portions that make electrical connection with predetermined other terminals of said interrupters, d. the predetermined terminals with which said first and second rod structures make electrical connection being such as to connect said interrupters electrically in parallel with each other between the conductive portions of said first and second rod structures, e. maintaining said conductive portions of one of said rod structures insulated from said tank, f. applying between said first and second rod structures across said interrupters in parallel a test voltage that is of insufficient value to cause a dielectric breakdown between said rod structures externally of said interrupters at the gas pressure then prevailing in the tank but is of sufficient value to produce a high probability of dielectric breakdown within any interrupter stressed by said voltage that has lost its vacuum, and g. determining whether a dielectric breakdown occurs within any of said stressed interrupters when said voltage is applied.

2. The method of claim 1 which further comprises providing an electrical connection between the conductor of one of said terminal bushings and a conductive portion of said first rod structure when said conductive portion makes electrical connection with one of said interrupter terminals, whereby said test voltage when applied as in (f) of claim 1 is applied to one of said interrupters through said one terminal bushing.

3. The method of claim 1 which further comprises the following steps performed before application of said test voltage:

a. providing an electrical connection between the conductor of one of said terminal bushings and a conductive portion of said first rod structure when said conductive portion makes electrical connection with its associated interrupter terminal, b. providing an electrical connection between the conductor of the other of said terminal bushings and a conductive portion of said second rod structure when said latter conductive portion makes electrical connection with its associated interrupter terminal.

4. The method of claim 1 in which said operation of said circuit breaker is performed in such a manner as to produce a gap between each set of separable contacts that is substantially shorter than the gap present when the circuit breaker is fully open.

5. The method of claim 1 in which:

a. prior to insertion of said rod structures, the pressure of the gaseous insulator in said tank is reduced to a value substantially equal to atmospheric pressure, and b. said test voltage is applied while said gaseous insulator is at substantially atmospheric pressure.

6. The method of claim 5 in which sealing means is provided between each of said rod structures and the wall of said tank to prevent contamination of the gaseous insulator remaining in said tank when said test voltage is being applied.

7. The method of claim 1 in which said conductive portions of said rod structures are spring pressed into positions where said electrical connections with said terminals are made, thus maintaining good electrical connections between said terminals and said conductive portions while said test voltage is being applied.

* * * * *